United States Patent [19]

McMillin

[11] Patent Number: 4,834,256

[45] Date of Patent: May 30, 1989

[54] CAN WITH DOMED BOTTOM STRUCTURE

[75] Inventor: Danny L. McMillin, Arvada, Colo.

[73] Assignee: PAC International, Inc., Arvada, Colo.

[21] Appl. No.: 80,350

[22] Filed: Jul. 31, 1987

[51] Int. Cl.[4] ..... B65D 6/02

[52] U.S. Cl. ..... 220/66; 220/72

[58] Field of Search ..... 220/66, 70, 72, 83, 220/18 C, DIG. 22

[56] References Cited

U.S. PATENT DOCUMENTS

| | | | |
|---|---|---|---|
| 919,345 | 4/1909 | Hackney | 220/DIG. 22 X |
| 3,170,590 | 2/1965 | Ullman et al. | 220/72 X |
| 3,730,383 | 5/1973 | Dunn et al. | 220/66 |
| 3,786,957 | 1/1974 | Hilgenbrink | 220/72 X |
| 3,814,279 | 6/1974 | Rayzal | 220/66 |
| 3,904,069 | 9/1975 | Toukmanian | 220/66 |
| 4,417,667 | 11/1983 | Roth et al. | 220/70 X |
| 4,685,582 | 8/1987 | Pulciani et al. | 220/66 |

*Primary Examiner*—Steven M. Pollard
*Attorney, Agent, or Firm*—Klaas & Law

[57] ABSTRACT

A one-piece can body member having a bottom section, a generally cylindrical side wall section, and an upwardly outwardly inclined connecting wall section connecting the bottom section to the cylindrical side wall section. The bottom wall section has an uppermost concave spherical central panel and a lowermost convexly curved annular support rib which provide an annular lowermost curved support surface for supporting the can body on a flat surface. An upwardly inwardly inclined frusto-conical connecting wall extends between the central panel and the support rib and is connected thereto by curved ends. The connecting wall comprises three frusto-conical straight side walls which are connected to one another by curved annular reinforcement ribs. The construction and arrangement enables stacking of cans having different diameter end members.

59 Claims, 4 Drawing Sheets

FIG. 4
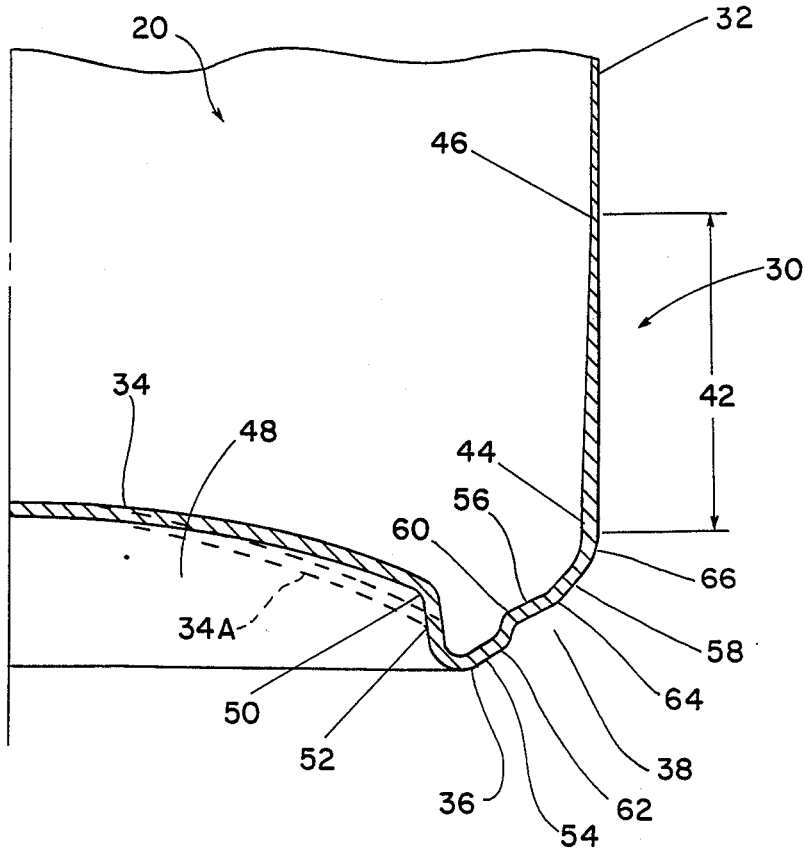
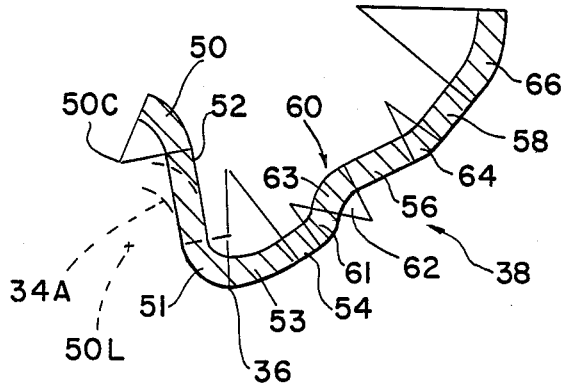
FIG. 4a

CAN WITH DOMED BOTTOM STRUCTURE

BACKGROUND OF THE INVENTION

This invention relates to the design and construction of can-type beer beverage containers for beer and soft drinks or the like, and more particularly, to a domed bottom structure for an one-piece can body of a two-piece can assembly.

At the present time, there are various shape and size aluminum and steel cans being used for beer and soft drink beverages or the like. Two-piece cans conventionally comprise an one-piece cup-shape body member and a top end lid member with an openable tab portion and an easy opening device integrally attached to the end member. In order to reduce the amount of metal required for manufacture of cans, some cans have reduced diameter neck portions whereby the end members of different kinds of cans may have varying diameters such as conventional 206 and 209 size end members. In addition, in order to also reduce the amount of metal, several types of conventional cans have domed bottom surfaces of varying sizes and shapes.

The present variety of sizes and shapes of end members and can members can cause problems in stacking of cans during handling, transportation and storage. In addition, present construction of domed bottom walls of can body members have created some problems in manufacture and have resulted in reduction of internal can volume. One of the manufacturing problems has been the ease of application and uniformity of internal coatings in the ridges and grooves formed in the dome structure. Another manufacturing problem occurs in forming operations wherein relatively large forces and special forming die construction are required to form the prior art dome construction.

SUMMARY OF THE INVENTION

A primary object of the present invention is to provide a dome structure which will enable stacking of cans of different size and shape having different size and shape end members.

Another object of the present invention is to provide a can bottom wall dome construction which facilitates reduction of metal wall thickness and reduction of forming forces and metal failure.

A further object is to provide a dome structure which facilitates application of internal coating materials.

In general, the dome structure of the present invention comprises a bottom wall section having an upwardly inwardly extending concave spherical central panel portion connected to a lowermost outwardly extending convex annular support rib portion by a downwardly extending frusto-conical straight wall portion. The rib portion is connected to a cylindrical thin side wall section by an upwardly outwardly inclined connecting wall section having three frusto-conical straight connecting wall portions connected by two annular curved reinforcement rib portions. The lowermost one of the straight connecting wall portions is connected to the bottom section support rib portion by a curved annular surface and is connected to the lower end of an intermediate one of the straight connecting wall portions by an annular concavely curved wall portion which defines a first lower one of the reinforcement rib portions. The upper end of the intermediate one of the straight connecting wall portions is connected to the lower end of an upper one of the straight connecting wall portions by an annular convexly curved wall portion which defines a second upper one of the reinforcement rib portions. The bottom wall section and the connecting wall sections have a substantially uniform thickness which is greater than the thickness of the side wall cylindrical sections. The upper end of the upper one of the straight connecting wall portions is connected to the can side wall cylindrical section by an upwardly inclined tapered connecting wall portion which gradually decreases in wall thickness from a maximum thickness at the lower end to a minimum thickness at the upper end equal to the thickness of the can side wall cylindrical section. The three straight connecting wall portions of the connecting wall section have varying horizontal angles of inclination of between approximately 25° and 50° and wherein the intermediate connecting wall portion has a lesser angle of inclination (e.g., approximately 25°) than the upper end lower connecting wall portions; and the lower connecting wall portion has a lesser angle of inclination (e.g., approximately 35°) than the upper connecting wall portion (e.g., approximately 50°). The upper convex reinforcement rib portion defines an annular pocket to provide abutment means for engaging the end members of certain types of reduced neck diameter cans and for enabling stacking of such cans one on top of another. The upper straight connecting wall portion provides a straight side surface to provide abutment means for engaging the end members of certain other types of large neck diameter cans and for enabling stacking of such cans. The radius of curvature of all curved surfaces in the bottom wall section and the connecting wall section are relatively large (e.g., 0.040 inch or larger) so as to provide coating flow surface means for enabling uniform application and drying of coating material applied thereto.

BRIEF DESCRIPTION OF THE DRAWING

An illustrative and presently preferred embodiment of the invention is shown in the accompanying drawings wherein:

FIG. 4 is a cross-sectional view of a portion of a can body showing the dome bottom wall and side wall construction of the present invention;

DETAILED DESCRIPTION OF THE INVENTION

Figure 1:
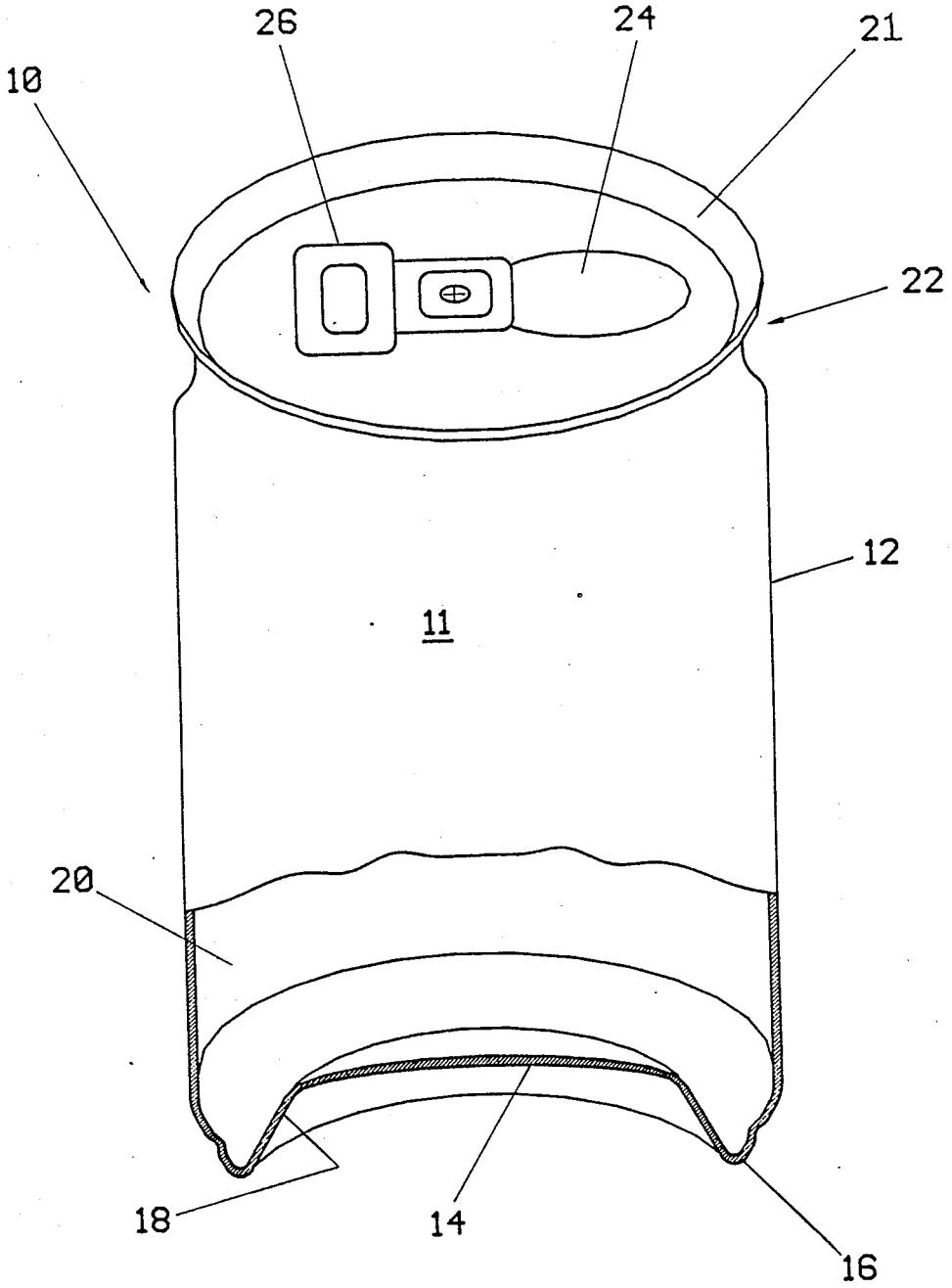
FIG. 1 is a perspective view of a conventional two-piece can having a standard full-size neck portion and end member.
Figure 2:
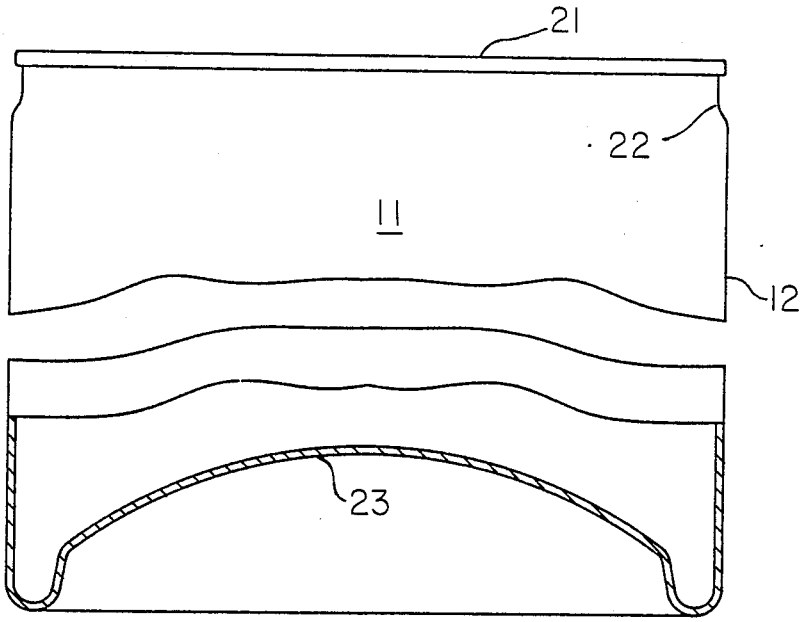
FIG. 2 is a side elevational view, partly in cross-section, of a conventional two-piece can having a standard full-size neck portion and end member.
Figure 3:
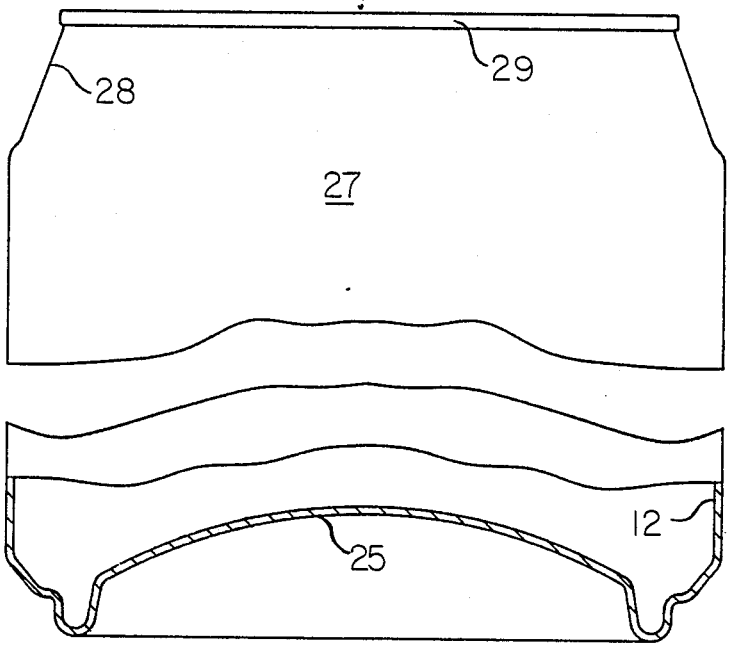
FIG. 3 is a side elevational view, partially in cross-section, of a conventional two-piece can having a reduced diameter neck portion and reduced diameter end member.

In general, FIG. 1 shows a conventional two-piece can assembly 10 comprising a conventional cylindrical can body member 11 having a cylindrical side wall portion 12, a domed bottom wall portion 14, a lowermost bottom rim portion 16 and an intermediate connection wall portion 18 which define a generally cylindrical chamber 20 to provide a can body member capable of receiving a particular volume of liquids such as beer or soft drinks. An inwardly extending upper neck portion 22 terminates in a flange (not shown) for attachment of end member 21 of substantially the same diameter as the can body member (e.g., a 209 size having a diameter of approximately 2-9/16 inches). The end member has an easy-open device 24 operably associated with an openable tab portion 26. FIG. 2 shows a two-piece can of the type shown in FIG. 1 with one type of conventional domed bottom structure 23. FIG. 3 shows another type of conventional two-piece can assembly 27 with another type of domed bottom structure 25 and wherein the upper neck portion 28 has a reduced diameter to receive a relatively small diameter end member 29 (e.g., a 206 size having a diameter of approximately 2-6/16 inches).

The new and improved can bottom structure of the present invention is shown in FIG. 4 which shows a portion of a cylindrical can body member 30 having a cylindrical side wall portion 32, a domed bottom wall portion 34, a lowermost bottom rim portion 36 and an upwardly outwardly extending intermediate connection wall portion 38 which define a generally cylindrical chamber 20 to provide a can body member capable of receiving a particular volume of liquids such as beer or soft drinks. The lower end portion 42 of side wall portion 32 is tapered inwardly and has an upwardly reduced wall thickness with a greater thickness at the bottom portion 44 than at the top portion 46. The thickness of bottom wall portions 34, 36, 38 are substantially the same as the thickness of the bottom portion 44 of the side wall.

Central domed portion 34 has a concave spherical configuration to provide a concave spherical cavity 48 and is connected to bottom rim portion 36 by a curved upper portion 50, and a straight radially outwardly inclined side wall portion 52. In the illustrative embodiment, the dome depth is approximately 0.365 inch and the center of curvature 50curved upper portion 50 is located vertically upwardly from the lower surface of bottom wall portion 36 a distance of approximately 0.140 inch. As shown by broken lines, for the same dome depth, tests have shown that the center of curvature 50L may be lowered to a vertical distance of approximately 0.090 inch whereby the central panel portion 34A will be lowered to increase can volume and to increase strength and to facilitate internal coating and to reduce forming die pressures. Bottom rim portion 36 has a first small radius portion 51 and a second larger radius portion 53. Connecting wall portion 38 comprises a lower straight wall portion 54, an intermediate upper straight wall portion 56 and an upper straight wall portion 58. Straight wall portions 54, 56 are connected by an annular inwardly extending curved rib portion 60 defining an annular outwardly facing shallow groove portion 62. Curved rib portion 60 has a first small radius portion 61 and a second larger radius portion 63. The rib portion 60 i displaced axially upwardly and radially inwardly a relatively small distance (e.g., approximately twice the wall thickness or less) from a line tangent to and extending between curved surfaces 61 and 64. Thus, in the illustrative embodiment wherein the thickness of wall portions 38 is approximately 0.012 to 0.013 inch, the displacement is approximately equal to or less than 0.024 to 0.026 inch. Intermediate straight wall portion 56 is connected to upper straight wall portion 58 by a curved portion 64 and upper straight wall portion 58 is connected to inclined wall portion 42 by a curved portion 66. Wall portion 54 horizontally is inclined at an angle of approximately 35°, wall portion 56 is horizontally inclined at an angle of approximately 25°, and wall portion 58 is horizontally inclined at an angle of approximately 50° relative to a horizontal plane. Wall portion 52 is inclined at an angle of approximately 9° and side wall portion 30 is tapered at an angle of approximately 2.5° relative to a vertical plane. In the illustrative embodiment, the thickness of side wall portion 32 is between approximately 0.004 and 0.005 inch, while the thickness of portions 34, 36 and 38 is between approximately 0.012 and 0.013 inch; and the approximate inside radius of curvature of each of the curved wall portions is as follows: portion 50 is 0.050; portion 51 is 0.040; portion 53 is 0.114; portion 61 is 0.040; portion 63 is 0.036; portion 64 is 0.062; and portion 66 is 0.150 (inch).

In design and manufacture of conventional two-piece can body members with domed bottom wall portions, the dome structure must have sufficient strength to prevent dome reversal under pressure of the fluids to be contained therein. For pasteurized beer and carbonated soft drinks, pressure specifications are typically approximately 90 psi to 110 psi. Most conventional aluminum can body members for pasteurized beer and soft drinks are made from aluminum sheet stock having a nominal gauge of 0.012 to 0.013 inch. In order to form a typical domed bottom wall structure, double action domer dies operating at high pressures (e.g., 7000 pounds force) are utilized. By use of the dome structure of the present invention, the dome reversal pressure resistance of a conventional can body, having a specified dome depth of approximately 0.400 inch to achieve 90 psi pressure resistance, has been increased from approximately the specified 90 psi to 120 psi. Thus, the dome depth of such a can may be reduced significantly to achieve the same 90 psi pressure specification. In addition, in formation of the dome structure of the present invention, single action domer apparatus has been employed with a relatively low operating pressure of approximately 1500 pounds of force. Another benefit of the present invention is that the gauge of the aluminum sheet stock material may be reduced from the conventional 0.012 to 0.013 inch gauge to 0.011 to 0.0115 inch gauge to provide tremendous savings of material and material costs.

Figure 5:
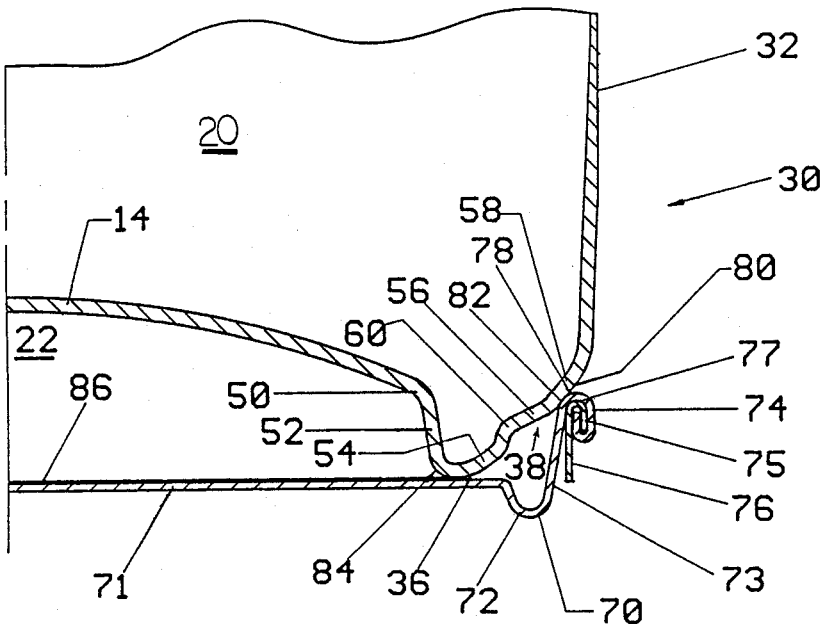
FIG. 5 is a cross-sectional view of a portion of the can body of FIG. 4 in association with a full-size end member.
Figure 6:
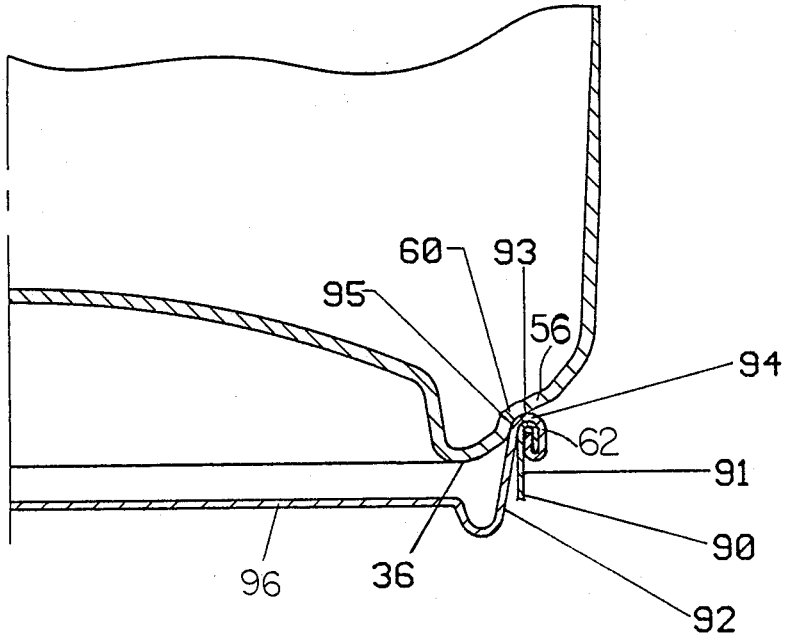
FIG. 6 is a cross-sectional view of a portion of the can body of FIG. 4 in association with a reduced diameter end member.

As shown in FIGS. 5 and 6, the foregoing construction and arrangement enables stacking of cans having either of the conventional neck and end construction and arrangements shown in FIGS. 1–3. FIG. 5 shows the apparatus of FIG. 4 in use with a conventional larger diameter (e.g. 209) end member 70 having a flat center panel portion 71, a curved rim portion 72, an outwardly extending wall portion 73, and a chime portion 74 in rolled sealed engagement with a flange portion 75 of a can body 76. Chime portion 74 is connected to wall portion 73 by a curved portion 77 having a curved surface 78. In the stacked position, straight outer side wall surface 80 of wall portion 58 slidably abuttably engages curved surface 78 at 82 while curved outer surface 84 of bottom rim portion 36 is located on the upper surface 86 of central panel portion 71 outwardly of the opening device (not shown). Thus, the upper can is fully stably supported on the lower can by two separate areas of engagement at 82 and 84. The construction and arrangement is such as to enable varying size cans and ends of the same general construction to be stacked since curved surface 78 may engage flat surface 80 at any location therealong.

FIG. 6 shows the can bottom construction of FIG. 4 in association with a can body member 90 having a reduced diameter can end portion 91 (e.g., 206) and end member 92 of the type shown in FIG. 2 wherein the curved surface 93 of chime portion 94 abuts curved surface 95 of curved rib portion 60 and chime portion 94 fits into the annular groove 62 with bottom rim portion 36 upwardly spaced from central panel portion 96 of end member 92 to provide clearance for the opening device (not shown). This arrangement also provides full stable support of the upper can on the lower can by circumferential engagement along curved surfaces 93 and 95 which is enabled by slidable downward movement along inclined side wall portion 56.

Thus, the can bottom construction of FIG. 4 provides a first stacking support means for a large diameter end member 70 comprising an uppermost inwardly inclined wall portion 58 which has a flat frusto-conical outer side surface 80 and a lowermost curved annular rim portion 36 having a curved lowermost annular surface 84. The same can bottom construction of FIG. 4 also provides a second stacking support means for a small diameter end member 90 comprising an intermediate curved annular wall portion 60 having a curved annular outer surface 95 and providing an annular groove 62 for receiving and supporting the curved annular surface 93 of chime portion 94.

In addition to the advantages of providing two separate stacking support means for different diameter end members, the can bottom wall construction of FIG. 4 also enables reduction of bottom wall thickness while maintaining rigidity and enables the uniform, complete application of a coating material to the inside surfaces of the bottom wall portion of the can body and subsequent drying of the material. Intermediate wall portion 52 has a relatively steep vertical angle of inclination while curved portions 36, 50 have easily formable radius of curvatures so as to prevent outward deflection of domed portion 34. Straight wall portions 54, 56, 58 are connected by easily formable curved portions 60, 64 which have sufficiently large radius of curvatures to enable application and drying of coating material while at the same time preventing outward deflection and providing two stacking support means. The slope and length of the straight portions 54, 56 and 58 also facilitate application and drying of the coating material.

While an illustrative and presently preferred embodiment of the invention has been shown and described, it is contemplated that the inventive concepts may be variously otherwise employed to achieve some or all of the advantages of the present invention. Thus, it is intended that the appended claims be construed to include alternative embodiments of the invention except insofar as limited by the prior art.

What is claimed is:

1. A relatively small size hand held can body member for beverages such as beer and soft drinks and being made of one piece of metallic sheet material and having a bottom section, a generally cylindrical side wall section, and an upwardly outwardly inclined connecting wall section connecting the bottom section to the cylindrical side wall section; and wherein:

the bottom wall section having an uppermost concave spherical central panel portion and a lowermost convexly curved annular support rib portion providing an annular lowermost curved support surface means for supporting the can body on a flat surface, an upwardly inwardly inclined frusto-conical connecting wall portion extending between said central panel portion and said support rib portion and being connected thereto by curved end portions; and the connecting wall section comprising at least three frusto-conical straight side wall portions which are connected to one another by curved annular reinforcement rib portions.

2. The invention as defined in claim 1 and wherein:

said frusto-conical straight side wall portions have varying horizontal angles of inclination.

3. The invention as defined in claim 2 and wherein:

said frusto-conical straight side wall portions including a lowermost side wall portion, an intermediate side wall portion, and an uppermost side wall portion;

said intermediate side wall portion having a lesser angle of inclination than said upper side wall portion and said lower side wall portion.

4. The invention as defined in claim 3 and wherein:

said uppermost side wall portion having an angle of inclination greater than the angle of inclination of said lowermost side wall portion and said intermediate side wall portion.

5. The invention as defined in claim 4 and wherein:

said angles of inclination vary between approximately 25° and 50°.

6. The invention as defined in claim 5 and wherein:

said lowermost side wall portion has an angle of approximately 35°;

said intermediate side wall portion has an angle of inclination of approximately 25°; and said uppermost side wall portion has an angle of inclination of approximately 50°.

7. The invention as defined in claims 1 or 6 and wherein:

said lowermost side wall portion is connected to said intermediate side wall portion by a concavely curved annular lowermost reinforcement rib portion; and said uppermost side wall portion is connected to said intermediate side wall portion by a convexly curved annular uppermost reinforcement rib portion.

8. The invention as defined in claim 7 and wherein:

said lowermost annular support rib portion has a first relatively small radius portion and a second relatively large radius portion.

9. The invention as defined in claim 7 and wherein:

said lowermost reinforcement rib portion defines an annular concave pocket providing a first abutment means for receiving and supporting the rim portion of a relative small diameter lid member of another can to enable vertical stacking of cans with the lower portions of the other can spaced above the upper surfaces of the lid member of the support can.

10. The invention as defined in claim 9 and wherein:

said uppermost side wall portion having an outer upwardly inclined side surface providing a second abutment means for receiving and supporting a relatively large diameter lid portion of another can to enable vertical stacking of cans and enabling a bottom rib portion of the other can to abuttingly engage the upper surface of the large diameter lid portion.

11. The invention as defined in claim 10 and wherein:

said central panel portion and said support rib portion of said bottom wall section are constructed and arranged to provide pocket means capable of receiving both relatively small diameter and relatively large diameter can lids.

12. A relatively small size hand held can body member for beverages such as beer and soft drinks and being made of one piece of metallic sheet material and having a bottom wall section, a relatively thin generally cylindrical side wall section, an upwardly outwardly inclined connecting wall section extending between the bottom wall section and the side wall section, and an upper end portion for attachment of an end member and wherein:

said bottom wall section comprising a central concave spherical wall portion, an annular concavely curved intermediate wall portion, a downwardly outwardly inclined straight intermediate frusto-conical wall portion, a convexly curved lowermost annular support rim wall portion providing an annular lowermost support surface means for supporting the can body member in a vertical attitude on a support surface; and said upwardly outwardly inclined connecting wall section comprising a first lowermost straight frusto-conical wall portion tangentially connected to said convexly curved lowermost annular support rim wall portion, a second intermediate straight frusto-conical wall portion connected to said first lowermost straight frusto-conical wall portion by a concavely curved first annular connecting wall portion, a third uppermost straight frusto-conical wall portion connected to said intermediate straight wall portion by a convexly curved second annular connecting wall portion, and a convexly curved uppermost third annular connecting wall portion connecting said uppermost straight wall portion to said generally cylindrical side wall section of said can body member.

13. The invention as defined in claim 12 and wherein said convexly curved lowermost annular support rim portion of the bottom wall section comprises:

a first curved wall portion of relatively small radius of curvature connected to said downwardly outwardly inclined straight intermediate frusto-conical wall portion; and a second curved wall portion of relatively large radius of curvature connecting said first curved wall portion to said first lowermost straight frusto-conical wall portion of the upwardly outwardly inclined connecting wall section.

14. The invention as defined in claim 13 and wherein:

said relatively small radius of curvature is less than one half the relatively large radius of curvature.

15. The invention as defined in claim 14 and wherein:

said relatively small radius of curvature is approximately 0.040 inch and said relatively large radius of curvature is approximately 0.114.

16. The invention as defined in claim 12 or 13 and wherein:

said downwardly outwardly inclined straight intermediate frusto-conical wall portion of the bottom wall section has a relatively small first included angle of inclination relative to a vertical plane and said first lowermost straight frusto-conical wall portion of the upwardly outwardly inclined connecting wall section has a relatively large second included angle of inclination relative to a vertical plane.

17. The invention as defined in claim 16 and wherein:

said relatively large included second angle of inclination is approximately 55°.

18. The invention as defined in claim 17 and wherein:

said relatively small first included angle of inclination is approximately 9°.

19. The invention as defined in claim 16 and wherein:

said second intermediate straight frusto-conical wall portion of the upwardly outwardly inclined connecting wall section has an included third angle of inclination relative to a vertical plane of which is larger than the said second angle of inclination.

20. The invention as defined in claim 19 and wherein:

said third angle of inclination is approximately 65°.

21. The invention as defined in claim 20 and wherein:

said third uppermost straight frusto-conical wall portion has an included fourth angle of inclination relative to a vertical plane which is larger than said second angle of inclination and smaller than said third angle of inclination.

22. The invention as defined in claim 21 and wherein:

said fourth angle of inclination is approximately 40°.

23. The invention as defined in claims 12 or 13 and wherein:

the relatively thin generally cylindrical side wall section having a lowermost vertically inclined and tapered wall portion of increasing thickness connected to said third uppermost straight frusto-conical wall portion by said convexly curved uppermost third annular connecting wall portion.

24. The invention as defined in claim 23 and wherein:

the bottom wall section and the upwardly outwardly inclined connecting wall section having a relatively large thickness which is larger than the relatively thin generally cylindrical side wall section above said lowermost inclined and tapered wall portion.

25. The invention as defined in claim 24 and wherein:

the thickness of the relatively thin generally cylindrical side wall section being less than approximately one-half the thickness of the bottom wall section and the connecting wall section.

26. The invention as defined in claim 25 and wherein:

the thickness of the relatively thin generally cylindrical side wall section being approximately 0.005 inch or less.

27. The invention as defined in claim 26 and wherein:

the thickness of the bottom wall section and the upwardly outwardly inclined connecting wall section being approximately 0.013 inch or less.

28. The invention as defined in claims 12 or 13 and wherein:

said central concave spherical wall portion of the bottom wall section having a maximum depth of between approximately 0.40 inch and 0.365 inch.

29. The invention as defined in claim 28 and wherein:

said central concave spherical wall portion of the bottom wall section having a maximum depth of approximately 0.365 inch or less.

30. The invention as defined in claim 21 and further comprising:

a convexly curved fourth annular connecting wall portion between and connecting said concavely curved first annular connecting wall portion to said first lowermost straight frusto-conical wall portion.

31. The invention as defined in claim 30 and wherein: the radius of curvature of said concavely curved first annular connecting wall portion being smaller than the radius of curvature of said convexly curved fourth annular connecting wall portion.

32. The invention as defined in claim 31 and wherein: the radius of curvature of said concavely curved first annular connecting wall portion being approximately 0.036 inch.

33. The invention as defined in claim 32 and wherein: the radius of curvature of said convexly curved fourth annular connecting wall portion being approximately 0.040 inch.

34. The invention as defined in claims 12 or 13 and wherein:

said first annular connecting wall portion defines an annular concave outer pocket providing a first abutment means for receiving and supporting the rim portion of a relative small diameter lid member of another can to enable vertical stacking of cans with the lower portions of the other can spaced above the upper surfaces of the lid member of the support can.

35. The invention as defined in claim 34 and wherein: said third uppermost straight frusto-conical side wall portion having an outer upwardly inclined side surface providing a second abutment means for receiving and supporting a relatively large diameter lid portion of another can to enable vertical stacking of cans.

36. The invention as defined in claim 35 and wherein: said second abutment means being constructed and arranged for enabling a bottom rib portion of the other can to abuttingly engage the upper surface of the large diameter lid portion.

37. The invention as defined in claim 35 and wherein: said central concave spherical wall portion and said lowermost annular support rim wall wall portion of said bottom wall section are constructed and arranged to provide pocket means of a size and shape capable of receiving both relatively small diameter and relatively large diameter can lids therewithin.

38. The invention as defined in claims 1 or 12 or 13 and wherein:

the construction and arrangement of the bottom wall section providing abutment means for stacking of cans having at least two different diameter neck and end construction and arrangements.

39. The invention as defined in claims 1 or 12 or 13 and wherein:

the bottom wall section having a construction and arrangement providing a first stacking support means for a relatively large diameter end member of another can.

40. The invention as defined in claim 39 and wherein: said first stacking support means comprising an uppermost inwardly inclined wall portion which has a flat frusto-conical outer side surface and a lowermost convexly curved annular rim portion having a curved lowermost annular surface.

41. The invention as defined in claim 40 and wherein: the bottom wall section having a construction and arrangement providing a second stacking support means for a relatively small diameter end member of another can.

42. The invention as defined in claim 41 and wherein: said second stacking support means comprising an intermediate concavely curved annular wall portion having a curved annular outer surface and providing an annular groove for receiving and supporting the curved annular surface of a chime portion of the small diameter end member with the flat upper surface of the central portion of the end member located in downwardly spaced non-abutting relationship to said curved lowermost annular surface of said lowermost convexly curved annular rib portion.

43. The invention as defined in claim 7 and wherein: said concavely curved annular lowermost rib portion being displaced axially upwardly and radially inwardly a relatively small distance approximately equal to twice the wall thickness or less.

44. The invention as defined in claim 43 and wherein: the thickness of said straight side wall portions is approximately 0.012 to 0.013 inch, and the displacement of said concavely curved rib portion is approximately equal to or less than 0.024 to 0.026 inch.

45. The invention as defined in claims 1 or 12 or 13 and wherein:

said relatively thin metallic sheet of material being made of an aluminum alloy.

46. The invention as defined in claim 45 and wherein: the dome structure has a dome depth of approximately 0.400 inch or less and an internal pressure resistance of approximately between 90 and 120 psi.

47. A relatively small size hand held can body member for beverages such as beer and soft drinks and being made of one piece of metallic sheet material and having a domed bottom section, a generally cylindrical side wall section, and an upwardly outwardly inclined connecting wall section connecting the domed bottom section to the cylindrical side wall section; and wherein:

the domed bottom wall section having an uppermost concave spherical central panel portion and a convexly curved annular lowermost support rib portion providing an annular lowermost curved support surface means for supporting the can body on a flat surface, an upwardly inwardly inclined frusto-conical connecting wall portion extending between said central panel portion and said support rib portion and being connected thereto by curved end portions;

said convexly curved annular lowermost support rib portion of the bottom wall section comprises:

a first curved wall portion of relatively small radius of curvature connected to said downwardly outwardly inclined straight intermediate frusto-conical wall portion; and a second curved wall portion of relatively large radius of curvature connecting said first curved wall portion to said upwardly outwardly inclined connecting wall section.

wherein said connecting wall section comprising at least three frusto-conical straight side wall portions which are connected to one another by curved annular reinforcement rib portions.

48. The invention as defined in claim 47 and wherein: said relatively small radius of curvature is less than one half the relatively large radius of curvature.

49. The invention as defined in claim 48 and wherein:

said relatively small radius of curvature is approximately 0.040 inch and said relatively large radius of curvature is approximately 0.114.

50. The invention as defined in claim 47 and wherein: said upwardly outwardly inclined connecting wall section comprising a lowermost wall portion tangentially connected to said convexly curved lowermost annular support rim wall portion, an intermediate straight frusto-conical wall portion connected to said lowermost wall portion by a concavely curved annular connecting wall portion, and an uppermost wall portion connected to said intermediate straight frusto-conical wall portion by a convexly curved annular connecting wall portion.

51. The invention as defined in claim 50 and wherein: said concavely curved annular connecting wall portion being laterally displaced axially upwardly and radially inwardly relative to said lowermost wall portion and said uppermost wall portion a relatively small distance approximately equal to approximately twice the wall thickness or less.

52. The invention as defined in claim 51 and wherein: the thickness of said the wall portions of said connecting wall section is approximately 0.012 to 0.013 inch, and the lateral displacement of said concavely curved annular connecting wall portion is approximately equal to or less than 0.024 to 0.026 inch.

53. The invention as defined in claim 52 and wherein: the radius of curvature of said concavely curved annular connecting wall portion being approximately 0.036 inch.

54. The invention as defined in claim 53 and said upwardly outwardly inclined connecting wall section further comprising:

a convexly curved annular connecting wall portion between and connecting said concavely curved annular connecting wall portion to said lowermost wall portion.

55. The invention as defined in claim 54 and wherein: the radius of curvature of said concavely curved annular connecting wall portion being approximately equal to or smaller than the radius of curvature of said convexly curved fourth annular connecting wall portion.

56. The invention as defined in claim 55 and wherein: the radius of curvature of said convexly curved fourth annular connecting wall portion being approximately 0.040 inch.

57. The invention as defined in claim 50 and wherein: said concavely curved annular connecting wall portion defines an annular concave outer pocket providing a first abutment means for receiving and supporting the rim portion of a relative small diameter lid member of another can to enable vertical stacking of cans with the lower portions of the other can spaced above the upper surfaces of the lid member of the support can.

58. The invention as defined in claim 57 and wherein: said uppermost wall portion having an outer upwardly inclined side surface providing a second abutment means for receiving and supporting the rim portion of a relatively large diameter lid member of another can to enable vertical stacking of cans.

59. The invention as defined in claim 57 and wherein: said second abutment means being constructed and arranged to enabling a lowermost support rib portion of the other can to abuttingly engage the central upper surface of the large diameter lid member.

* * * * *

UNITED STATES PATENT AND TRADEMARK OFFICE

CERTIFICATE OF CORRECTION

PATENT NO. : 4,834,256

DATED : May 30, 1989

INVENTOR(S) : Danny L. McMillin

It is certified that error appears in the above-identified patent and that said Letters Patent is hereby corrected as shown below:

Column 2, line 53, "Fig. 4 is" should read --Figs. 4 and 4(a) are--; line 57, "body of Fig. 4" should read --body of Figs. 4 and 4(a)--; and line 60, "Fig. 4" should read --Figs 4 and 4(a)--.

Column 3, line 21, "Fig. 4 which shows" should read -- Figs, 4 and 4(a) which show--; line 42, "curvature 50curved" should read --curvature 50c for curved--; and line 61, "60 i" should read --60 is--.

Column 4, line 53, "Fig. 4" should read --Figs. 4 and 4(a)--;
Column 5, line 4, "Fig. 4" should read --Figs. 4 and 4(a)--;
line 18, "Fig. 4 provides" should read --Figs. 4 and 4(a) provide--.
line 24, "Fig. 4" should read --Figs. 4 and 4(a)--; and
line 33, "Fig. 4" should read --Figs. 4 and 4(a)--.

Claim 59, Column 12, line 33, "to" should read --for--.

Signed and Sealed this

Thirtieth Day of January, 1990

*Attest:*

JEFFREY M. SAMUELS

*Attesting Officer*

*Acting Commissioner of Patents and Trademarks*